US009165440B1

(12) United States Patent
Baldwin et al.

(10) Patent No.: US 9,165,440 B1
(45) **Date of Patent: *Oct. 20, 2015**

(54) MULTI-SENSORY WARNING DEVICE

(71) Applicant: Mallory Sonalert Products, Inc., Indianapolis, IN (US)

(72) Inventors: Christopher M. Baldwin, Avon, IN (US); Daniel W. O'Brien, Mooresville, IN (US)

(73) Assignee: Mallory Sonalert Products, Inc., Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/186,711

(22) Filed: Feb. 21, 2014

Related U.S. Application Data

(63) Continuation of application No. 13/327,089, filed on Dec. 15, 2011, now Pat. No. 8,797,176.

(51) Int. Cl.
*G08B 5/22* (2006.01)
*G08B 7/06* (2006.01)

(52) U.S. Cl.
CPC ..... *G08B 7/06* (2013.01)

(58) Field of Classification Search
CPC ..... G08B 5/22
USPC ..... 340/815.45, 388.1, 388.4, 384.1, 384.6, 340/391.1
See application file for complete search history.

(56) References Cited

U.S. PATENT DOCUMENTS

| | | | |
|---|---|---|---|
| 3,638,223 | A | 1/1972 | Potter |
| 3,815,129 | A | 6/1974 | Sweany |
| 3,922,672 | A | 11/1975 | Birt et al. |
| 4,104,628 | A | 8/1978 | Sweany et al. |
| 4,156,156 | A | 5/1979 | Sweany et al. |
| 4,180,808 | A | 12/1979 | Lebet et al. |
| 4,183,020 | A | 1/1980 | Schade |
| 4,213,121 | A | 7/1980 | Learn et al. |
| 4,429,247 | A | 1/1984 | Feldman |
| 4,558,305 | A | 12/1985 | Black et al. |
| 4,626,799 | A | 12/1986 | Matievic |
| 4,697,932 | A | 10/1987 | Matievic |
| 4,700,100 | A | 10/1987 | Congdon et al. |
| 4,719,452 | A | 1/1988 | Logsdon |
| 4,904,982 | A | 2/1990 | Lieb et al. |
| 4,945,346 | A | 7/1990 | Schmiemann |
| 5,163,447 | A | 11/1992 | Lyons |

(Continued)

OTHER PUBLICATIONS

Baldwin et al. U.S. Appl. No. 13/327,089, Multi-sensory Warning Device filed Dec. 15, 2011.*

(Continued)

*Primary Examiner* — Toan N Pham

(74) *Attorney, Agent, or Firm* — William F. Bahret

(57) ABSTRACT

A panel-mountable audible and visual warning device comprising a main housing and a cap thereon, the device configured to have the main housing fit into a hole in the face of a mounting panel and to have the front wall and side wall of the cap external to the panel when the device is operably mounted therein, with the cap containing a piezoelectric transducer and at least one LED as a modular subassembly which is attached to the main housing. The cap and transducer together define an audio-frequency resonant cavity, and the cap has the LED (s) mounted therein in a position in front of the panel face in use and behind and radially outward of the transducer so as to emit light directly forward past the transducer.

16 Claims, 9 Drawing Sheets

(56) References Cited

U.S. PATENT DOCUMENTS

| | | | |
|---|---|---|---|
| 5,293,155 | A | 3/1994 | Nicol et al. |
| 5,386,479 | A | 1/1995 | Hersh |
| 5,675,311 | A | 10/1997 | Burnett et al. |
| 5,675,312 | A | 10/1997 | Burnett |
| 5,793,282 | A | 8/1998 | Arnold et al. |
| 5,872,506 | A | 2/1999 | O'Brien et al. |
| 5,990,784 | A | 11/1999 | Burnett |
| 6,130,618 | A | 10/2000 | Burnett et al. |
| 6,310,540 | B1 | 10/2001 | Burnett et al. |
| 6,414,604 | B1 | 7/2002 | Burnett et al. |
| 6,512,450 | B1 | 1/2003 | Burnett et al. |
| 6,617,967 | B2 | 9/2003 | Baldwin et al. |
| 6,756,883 | B2 | 6/2004 | Burnett et al. |
| 6,987,445 | B1 | 1/2006 | Burnett et al. |
| 7,505,600 | B2 | 3/2009 | Dryer |
| 7,584,743 | B2 | 9/2009 | Godbold |
| 7,880,593 | B2 | 2/2011 | Baldwin et al. |
| 7,920,069 | B2 | 4/2011 | Shain et al. |
| 8,797,176 | B1 | 8/2014 | Baldwin et al. |
| 2005/0219040 | A1 | 10/2005 | Dryer |
| 2007/0057778 | A1 | 3/2007 | Prince et al. |
| 2010/0102940 | A1 | 4/2010 | Baldwin et al. |

OTHER PUBLICATIONS

MC9S08QD4 Series MCU Data Sheet, Rev. 6, © 2006-2010 Freescale Semiconductor, Inc., 198 pgs.

RE46C100 Piezoelectric Horn Driver Circuit Product Specification, © 2009 Microchip Technology Inc., 4 pgs.

RE46C101 Piezoelectric Horn Driver and LED Driver Circuit Product Specification, © 2009 Microchip Technology Inc., 4 pgs.

"Signaling Solutions," Rockwell Automation Publication 855-BROO1C-EN-P, © 2010 Rockwell Automation, Inc., 8 pgs.

Maxim Application Note 4148, "Piezoelectric Tone Generation Using the MAXQ3210," Nov. 15, 2007, © Maxim Integrated Products, 6 pgs.

MAXQ3210 Data Sheet, "Microcontroller with Internal Voltage Regulator, Piezoelectric Horn Driver, and Comparator," Rev. 1; 5/06, © 2006 Maxim Integrated Products, 28 pgs.

* cited by examiner

MULTI-SENSORY WARNING DEVICE

CROSS-REFERENCE TO RELATED APPLICATION

This application is a continuation of patent application Ser. No. 13/327,089, filed Dec. 15, 2011, now U.S. Pat. No. 8,797,176, issued Aug. 5, 2014, which application and patent are hereby incorporated by reference along with all references cited therein.

BACKGROUND OF THE INVENTION

This invention relates to audible and audible/visual warning devices. For the sake of safety and efficiency, it is important that operators of machinery and other equipment experience sensory feedback when operating machine and equipment controls. Sensory feedback may be audible, visual or tactile, and it is common to provide only one kind of sensory feedback, such as an audible warning device emitting only sound.

More recently, to keep pace with machine designers who continually strive to reduce size and cut costs in order to provide greater value to their customers, sensory devices have been developed which offer more than one kind of sensory feedback in a single package. For example, audible devices are available which have an embedded light-emitting diode (LED) so that both audible and visual signals can be generated simultaneously. It is also known to incorporate a light in a pushbutton switch, e.g., to provide a visual indication to help the operator more quickly locate the switch.

However, sensory device designers have faced challenges in providing multi-sensory warning devices in compact packages and achieving desired levels of performance and cost. For example, in panel-mount alarms employing a sound generating element such as a speaker or piezoelectric transducer, the housing is generally sized for the speaker or transducer so there is little or no side space available for a light source. Rear lighting presents problems because conventional speakers and piezoelectric transducers are opaque, and front mounting of a light source presents problems due to the need for electrical wiring for the light source. One approach to front mounting involves running wires through holes created in a piezoelectric transducer, as described in U.S. Pat. No. 6,130,618, which is incorporated herein by reference. As an alternative, it has been proposed to provide lighting from inside the panel in which the warning device is mounted, using LEDs mounted behind the piezoelectric transducer in a light-transmissive housing so that light is transmitted around the transducer from behind the plane of the panel through a length of the housing wall, as described in U.S. Pat. No. 7,920,069. Such a design compromises the brightness of the light emitted from the warning device.

A need remains for improvements in the design of warning devices in compact packages, particularly warning devices which integrate sound and light and/or other functions in housings suitable for panel mounting or similar applications.

SUMMARY OF THE INVENTION

The present invention provides a panel-mountable audible and visual warning device comprising a main housing and a cap thereon, the device configured to have the main housing fit into a hole in the face of a mounting panel and to have the front wall and side wall of the cap external to the panel when the device is operably mounted therein, with the cap containing a piezoelectric transducer and at least one LED. The cap and transducer together define an audio-frequency resonant cavity, and the cap has the LED(s) mounted therein in a position in front of the panel face in use and behind and radially outward of the transducer so as to emit light directly forward past the transducer.

The objects and advantages of the present invention will be more apparent upon reading the following detailed description in conjunction with the accompanying drawings.

BRIEF DESCRIPTION OF THE DRAWINGS

FIG. 9C includes a front view of the shutter juxtaposed with the slots for context.

FIGS. 1-11 are scale drawings.

DESCRIPTION OF PREFERRED EMBODIMENTS

Figure 1:
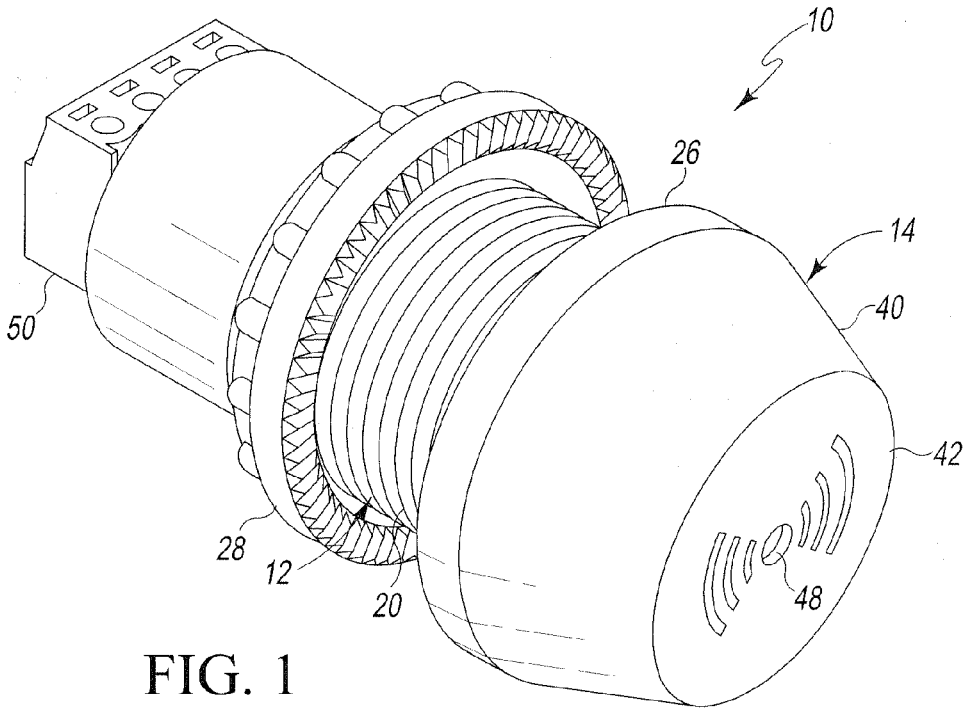
FIG. 1 is an upper left perspective view of one embodiment of a multi-sensory warning device according to the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

FIGS. 1-6 illustrate one embodiment of a multi-sensory warning device 10 according to the present invention. This embodiment is particularly suited for panel mounting, i.e., mounting in a control panel of a machine, appliance or the like, or on a vehicle dashboard, although it is not limited to mounting in a control panel per se. For example, panel-mount warning devices are sometimes externally installed using mounting brackets which are designed for that purpose and thus serve as panels themselves. Warning device 10 has a hollow housing 12 with a cap 14 on the front end thereof, the cap containing a piezoelectric transducer 16 which is controlled by an electronic circuit 18 contained in the main body portion of the housing. The main housing portion includes a threaded, cylindrical barrel 20 which is sized to fit into a hole in a panel and, in one preferred embodiment of the invention, has an outer diameter of approximately 22 mm.

The housing may have a unitary construction which includes the cap, e.g., a one-piece molded housing. However, in the illustrated embodiment, cap 14 is a separate modular assembly having piezoelectric transducer 16, an LED light source 22, and an electrical connector 24 mounted therein, and having a frusto-conical shape as shown in the drawings. The outer diameter of the piezoelectric transducer is substantially equal to or greater than that of threaded barrel 20, and the rear portion of the cap is larger in outer diameter than the barrel. For example, the disclosed transducer's outer diameter is approximately 20 mm, compared to 22 mm for the barrel. The rear portion of the cap is approximately 30 mm in diameter and its front portion is approximately 23 mm in diameter. The transducer is designed to operate at approximately 3.5 kHz. One alternative piezoelectric transducer, designed to operate at approximately 2 kHz, has an outer diameter of approximately 35 mm and is contained in a cap like the one shown but proportionately wider, i.e., with front and rear portion diameters of approximately 40 and 53 mm, respectively. The cap is pre-assembled and then electrically connected to the control circuit 18 in the main housing by means of its internal connector 24, and secured, e.g., adhesively or ultrasonically bonded, to a flange 26 on the front end of the main housing. The flange and the entire cap assembly are external to the panel when the device is operably mounted therein, with the flange abutting the face of the panel. The installed device is held in place with a nut 28 screwed onto the threaded barrel of the housing from behind the panel.

Figure 2:
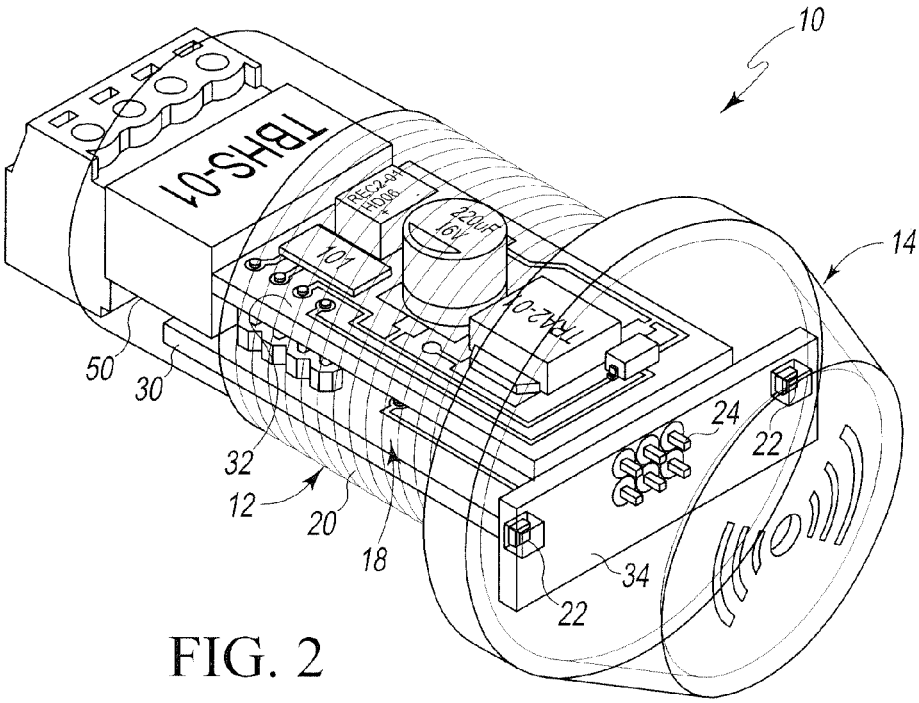
FIG. 2 shows the warning device of FIG. 1 with the cap and threaded housing shown transparent to reveal internal components.
Figure 4:
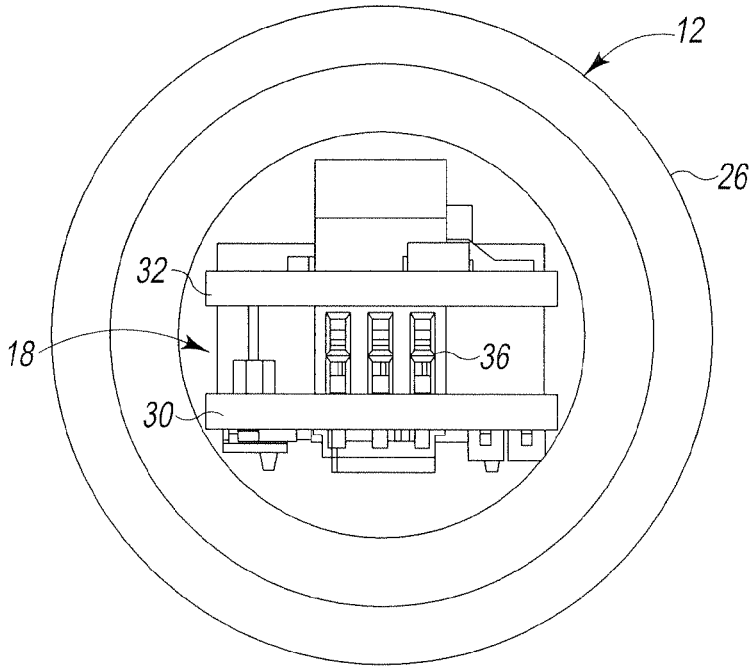
FIG. 4 is a front view of the warning device of FIG. 1 with the cap removed, showing the internal electrical circuitry on a piggyback printed circuit board (PC board).
Figure 6:
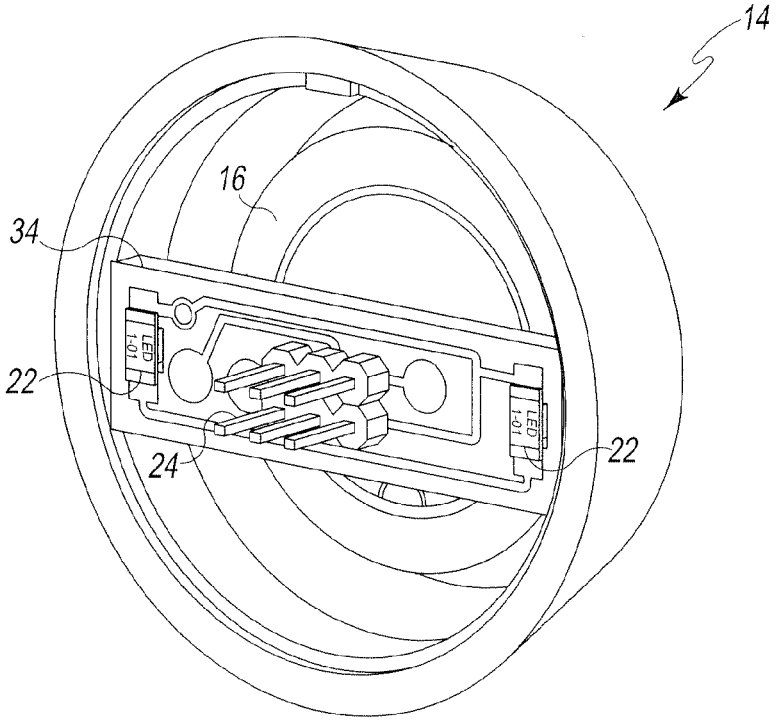
FIG. 6 is right rear perspective view of the cap assembly of FIG. 5.

In FIG. 2, the threaded main portion of the housing and the cap are shown transparent to illustrate the internal circuitry, which includes control circuit 18 mounted on PC boards 30 and 32 which are interconnected in a piggyback configuration within the main housing, and two LEDs 22 on opposite ends of a PC board 34 mounted within the cap behind the transducer. Referring also to FIGS. 4 and 6, the main PC board 30 has a terminal block 36 centrally mounted on the front end thereof and aligned with six centrally located terminal pins forming male connector 24 on PC board 34 for detachable electrical connection of the circuit boards. PC board 34 is supported by the side wall 40 of the cap, with the ends of the board held within recesses formed in the side wall for that purpose. The housing flange has a raised annular portion that fits into the relief in the rear of the cap and presses against the PC board to help hold it in place. The cap is preferably keyed to the flange by a peripheral tab on the rear of the cap and a corresponding keyway on the raised annular portion of the flange.

Figure 5:
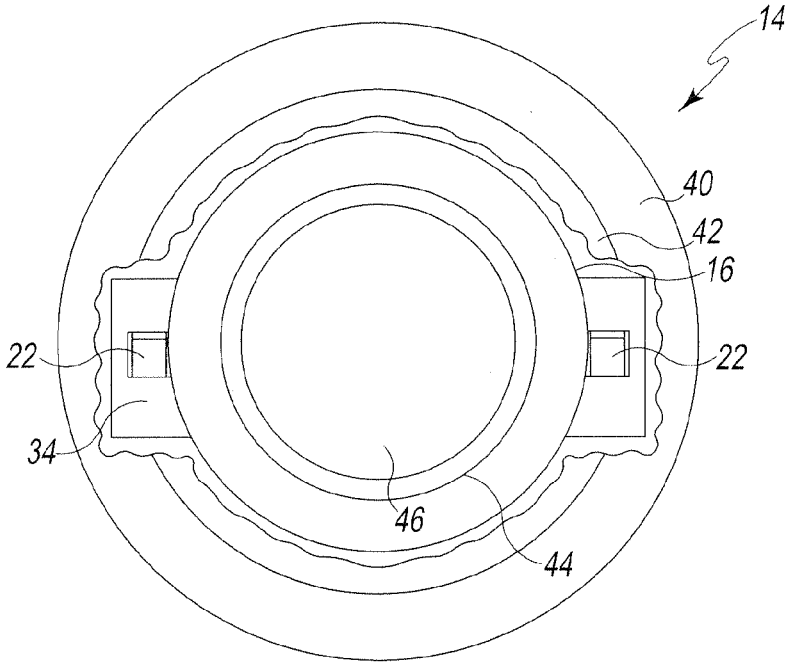
FIG. 5 is a front view of the cap assembly with the front wall cut away to show a piezoelectric transducer and two LEDs contained in the cap, with the LEDs peripherally mounted on a PC board supported by the side wall of the cap such that the LEDs are radially outward of the transducer.

As shown in FIGS. 5 and 6, piezoelectric transducer 16 is mounted in the cap in front of PC board 34. LEDs 22 are preferably but not necessarily mounted on a PC board. Significantly, however, the LEDs are peripherally mounted such that they are radially outward of the transducer and emit light directly forward past the transducer to the front wall 42 of the cap, which may be made of a transparent or translucent polymer such as nylon 6/6. The front wall is substantially flat and may have a thickness of approximately 0.040", and the immediately adjacent portion of the side wall may have the same wall thickness. Preferably, the entire body of each LED is radially outward of the periphery of the transducer, e.g., as shown in FIG. 5 or as in FIG. 7 discussed below. The LEDs emit light through internal air space to the front wall and also emit light through the side wall with an unobstructed field of view because they are located in front of the panel face during use. Because of the multiple LEDs, there is an LED in a direct line of sight from any angle in a 180° field of view. Matching colors are contemplated for the LEDs and the cap, e.g., a red translucent cap with red LEDs, a green cap with green LEDs, etc. While two LEDs are shown in the drawings, it is also contemplated to have three or more LEDs with equal angular spacing, and with independent control allowing for sequential operation as will be described.

Figure 3:
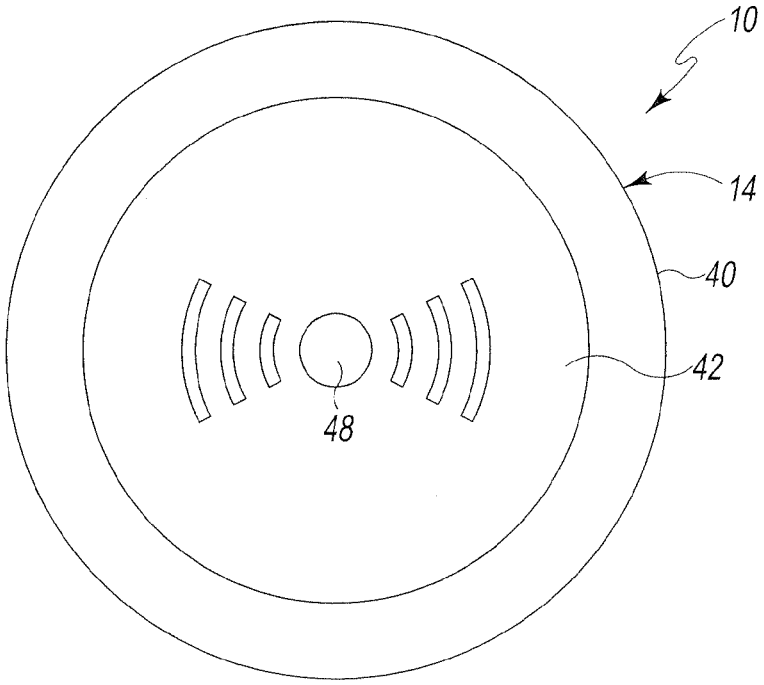
FIG. 3 is a front view of the warning device of FIG. 1.

The piezoelectric transducer is preferably nodally mounted, i.e., mounted at its nodal diameter, on a knife edge of a solid ring 44 having a corresponding inner diameter and a predetermined axial dimension within the cap so as to form, with the transducer and the front wall, an audio-frequency resonant cavity or chamber 46 having a resonant frequency that is near and preferably equal to the piezoelectric transducer's fundamental resonant frequency. Frequencies in the range of approximately 20 Hz to 20 kHz are audible to the average human. The transducer is preferably operated in the mid-audio range, extending from approximately 1.5 to 4.5 kHz, such as at frequencies of approximately 2, 3 or 3.5 kHz as particular examples. The resonant cavity is a closed chamber except for a sound orifice or opening 48 provided in the center of the front wall as shown in FIGS. 1-3. A grille having multiple sound orifices may be used instead of or in addition to orifice 48. The transducer may be attached to the nodal ring with an adhesive, e.g., a room temperature vulcanizing (RTV) silicone bead, as shown in U.S. Pat. No. 6,130,618, for example. Edge mounts and center mounts may be useful for certain applications, but, in the preferred embodiments, nodal mounting is used in order to avoid or minimize damping of transducer oscillations and thereby achieve higher sound levels efficiently with a given size package.

The piezoelectric transducer and drive circuit are preferably also configured to generate positive feedback as disclosed in U.S. Pat. No. 6,130,618 and also U.S. Pat. No. 3,815,129, which is incorporated herein by reference, in order to achieve high sound levels in a small package. The device preferably employs a three-terminal feedback-type piezoelectric transducer connected to the control circuit using three of the six pins of connector 24. Two of the three other pins of connector 24 are shared by the two LEDs, which are connected in parallel on PC board 34; for independent control, one lead of each LED is connected to its own pin of connector 24.

Circuit 18 drives the piezoelectric transducer and the LEDs in response to an input from an external controller or other source via an edge connector 50 on the rear end of main PC board 30. The input may simply be a power input, i.e., an AC or DC voltage to turn the circuit on when desired, or it may be a command or trigger signal to a circuit which is continually energized. Edge connector 50 has four pins in the illustrated embodiment, two of which are used for power and two of which may be used for mode control. The circuit as shown in FIGS. 1 and 4 is adapted for AC power input to the edge connector, and includes an AC rectifier on piggyback board 32 mounted on main PC board 30 to provide DC power to the drive circuitry on main PC board 30. Board 32 is not necessary in DC versions of the warning device.

Figure 7:
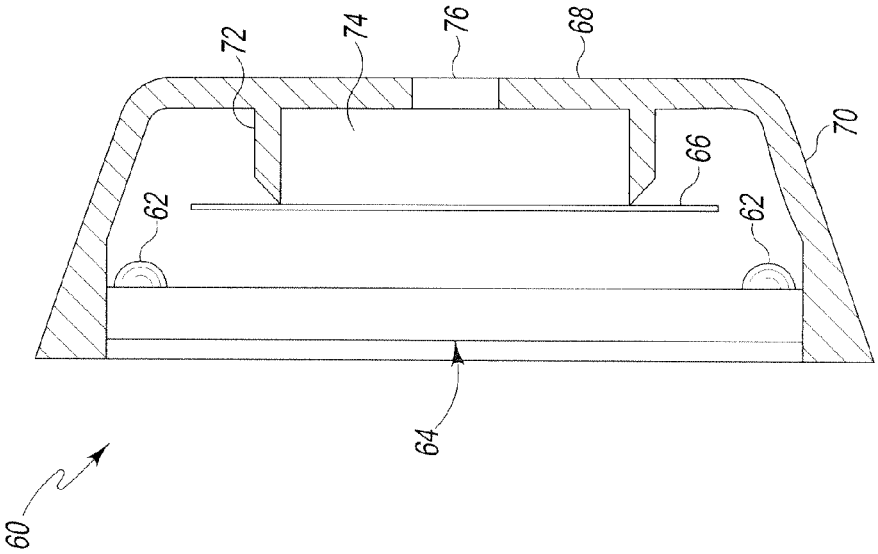
FIG. 7 is a cross-section of an embodiment of a cap assembly including LEDs.
Figure 8A:
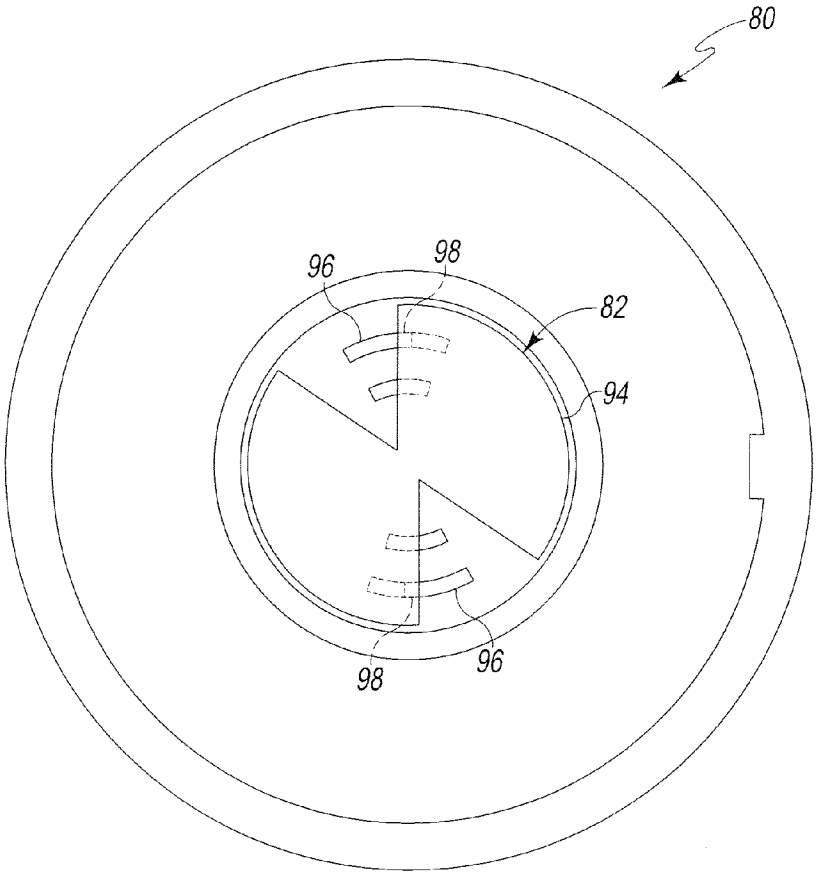
FIG. 8A is a rear view of the cap of FIG. 8 and the internal shutter, showing four slots in a grille in the front wall, with half of each slot visible and the other half hidden but symmetrical with the visible half.
Figure 8:
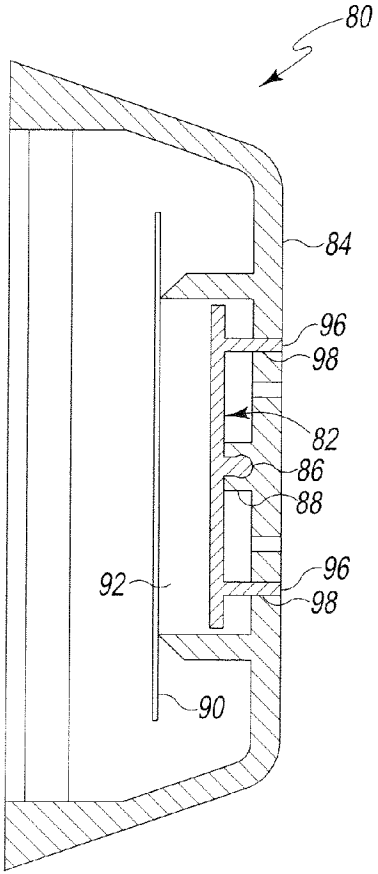
FIG. 8 is a cross-section of an embodiment of a cap assembly including an internal shutter.
Figures 9A, 9B, 9C:
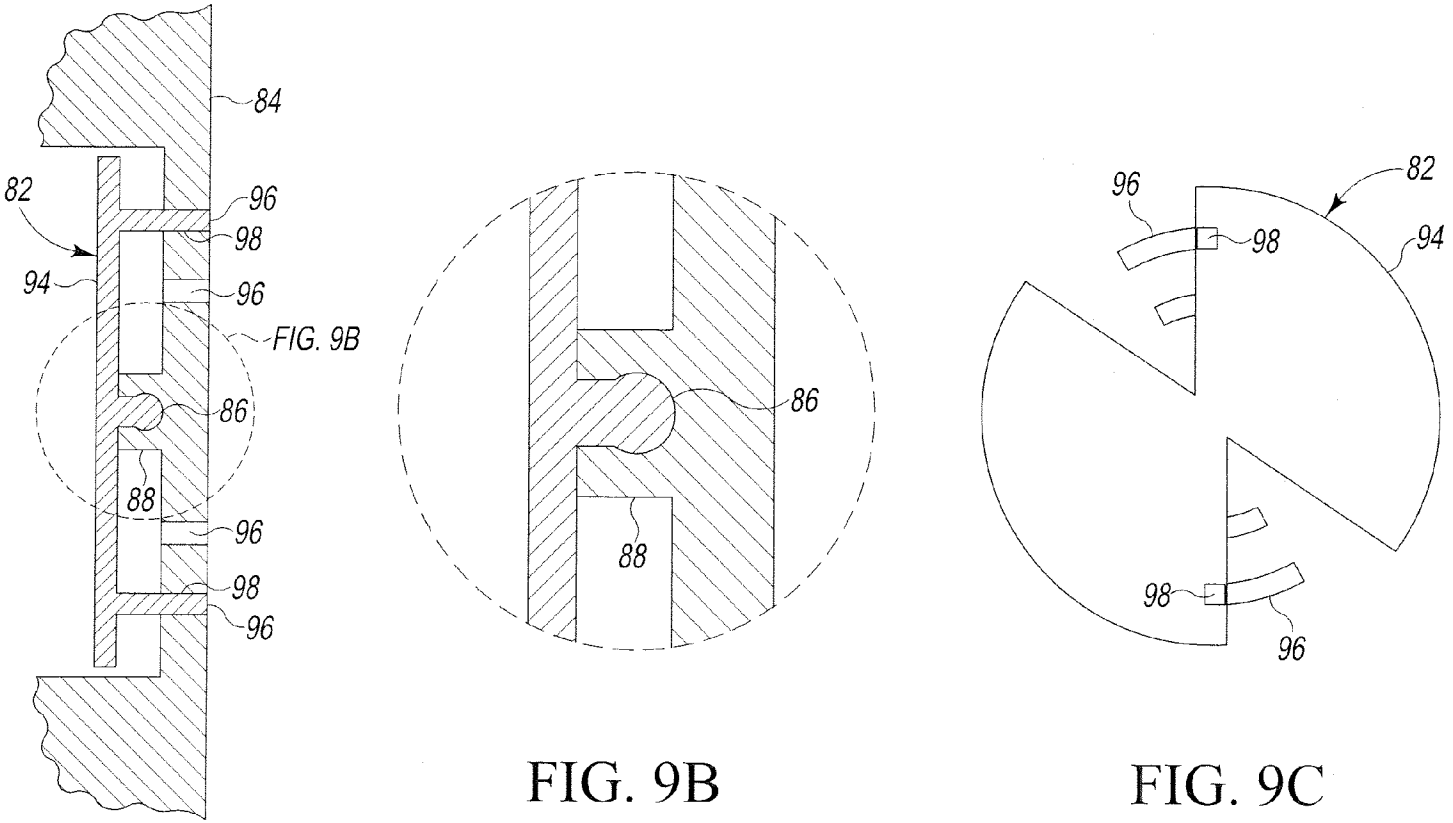
FIGS. 9A, 9B and 9C illustrate further details of the internal shutter of FIG. 8.

FIGS. 7-9 show various configurations of a cap assembly which may be attached to the flange on the front end of the main housing of FIG. 1. Like the first embodiment, cap 60 in FIG. 7 has LEDs 62 peripherally mounted on a wall-mounted PC board 64 such that they are radially outward of a nodally mounted piezoelectric transducer 66 and emit light directly forward past the transducer and through the front wall 68 of cap 60, and the LEDs also emit light through the side wall 70, with a combined 180° field of view. The cap's front and side walls may be made of the same transparent/translucent material with the same wall thicknesses as the first embodiment. The piezoelectric transducer is nodally mounted on the knife edge of a solid ring 72 to form a resonant cavity 74 which has a sound orifice 76 in the center of the front wall. As example dimensions for this and the other embodiments shown in the drawings, the corner between the front and side walls of the cap may have an inside radius of curvature of 0.040" and an outside radius of 0.080", and the side wall may taper in outer diameter from 1.2" at its rear end to 0.95" at the corner. The axial length of the cap, i.e., its length along a horizontal axis in FIG. 7, may be 0.4". The resonant cavity may have a 0.5" inner diameter (the inner diameter of the nodal ring) and an axial length of 0.135", and the sound orifice may have a 0.120" diameter and an axial length of 0.040" (the front wall thickness). The cap has a generally cylindrical area where the PC board is mounted, with a 1" inner diameter, and has a 0.13" gap between the board and the transducer. The LEDs are immediately adjacent the side wall in the cylindrical area of the cap.

FIGS. 8 and 9 show a cap assembly 80 with an internal volume control shutter 82. Shutter 82 is rotatably mounted to the front wall 84 of the cap by means of a pivot pin 86 with a rounded head mounted in a socket 88 provided on the rear surface of the front wall, which in this embodiment does not have a through hole in the center thereof. The shutter may be made of the same material as the cap, e.g., nylon 6/6, such that they are both semi-rigid with some resilience, and the socket may be split longitudinally, e.g., into four quadrants, so as to allow expansion of its narrower-diameter entrance portion during insertion of the pin, thereby providing a snap fit. The cap assembly has a piezoelectric transducer 90 and a resonant cavity 92, and the shutter is inside the resonant cavity and includes a movable plate 94 for selectively covering sound orifices in the form of concentric curved slots 96 in a grille as shown in FIG. 8A. In the disclosed embodiment, there is a gap between the front surface of plate 94 and the rear surface of the front wall. Alternatively, the plate and/or the front wall may be formed such that the plate is flush with the rear surface of the front wall. For example, in one embodiment, plate 94 has a center hole instead of pin, and a mating pin is provided on the rear surface of the front wall, preferably providing a snap fit such as that provided by round-headed pin 86 in socket 88. The shutter includes two fingers 98 extending axially from the plate into respective slots to provide external access to the internal shutter, such as with a narrow, pointed object inserted into a slot to move one of the fingers. The ends of the fingers are flush with the front wall surface as illustrated, but may alternatively be recessed or protrude out of the slots.

The shutter is preferably movable continuously between positions in which slots 96 are completely covered and completely uncovered, thereby allowing continuous control of the volume of the sound emitted from the warning device. The spacing of the piezoelectric transducer from the front wall is greater than in the prior embodiments to account for the displacement of air by the shutter within the cavity and because of the difference in the total volume of the sound orifice(s). Otherwise, the cap assembly may be the same as in FIG. 7, and may include the LEDs of that embodiment in addition to the shutter just described. With an internal shutter, the warning device is more aesthetically pleasing than it would be with an exposed shutter over a grille on the front of the device, and the device is more tamper-resistant.

Figure 10B:
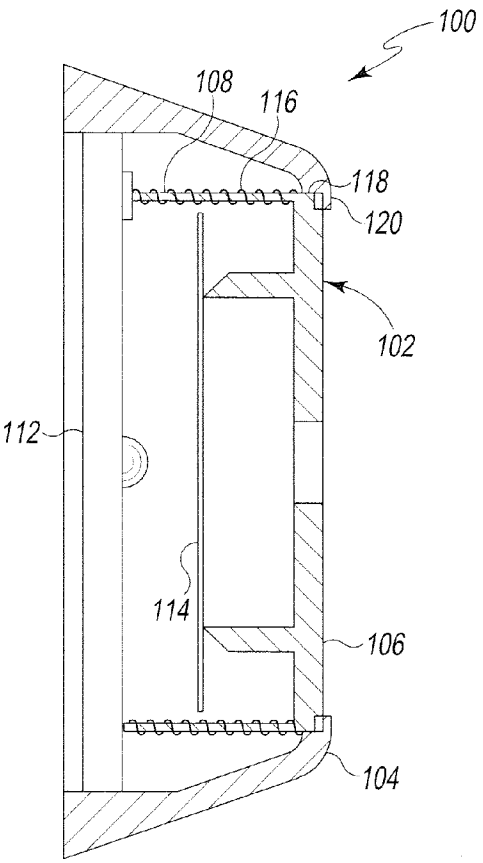
FIGS. 10A and 10B are cross-sections of an embodiment of a cap assembly including an integral momentary pushbutton switch, showing the switch in its released and actuated states, respectively.
Figure 10A:
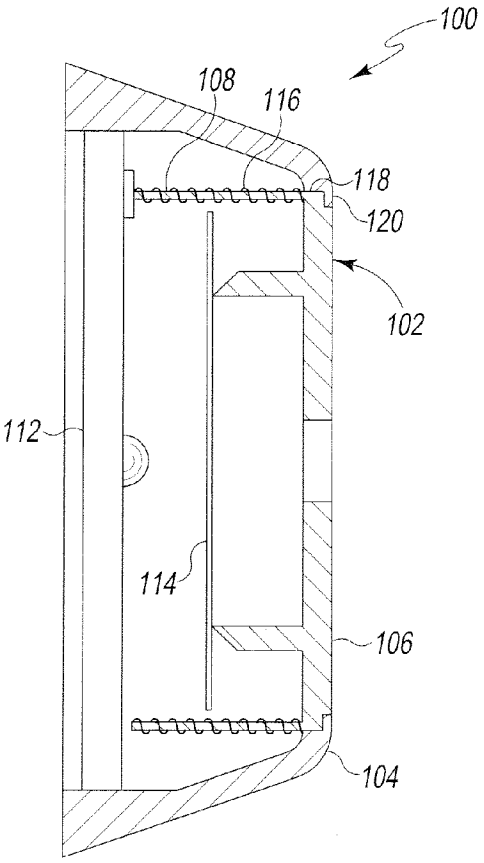

FIGS. 10A and 10B show an embodiment of a cap assembly 100 including an integral pushbutton switch 102 which is preferably a momentary switch. FIGS. 10A and 10B are longitudinal cross-sections of the cap assembly showing the switch mechanism in its released and actuated states, respectively. The front wall 104 of the cap includes a movable central plate 106 operably connected by one of two diametrically opposed rigid plastic posts 108 to a microswitch or other internal switch 110 peripherally mounted on a PC board 112 behind a piezoelectric transducer 114 which has a nodal mount as in FIG. 7. The posts may be formed in the same mold as the plate and the nodal ring to form a one-piece pushbutton which is spring biased toward the front of the cap by a compression spring 116 around each post. Plate 106 is retained in the cap by a recessed edge portion 118 which engages a lip 120 provided around the opening in front wall 104. The microswitch, which may be a Panasonic EVP-AA002K light-touch SPST switch, for example, is radially outward of the periphery of the transducer as shown, with its actuating button aligned with the post, and it is electrically connected through an electrical connector in the cap to the control circuit in the main housing. Alternatively, switch 110 may comprise a movable electrical contact and a stationary electrical contact or contacts on the PC board, with the post aligned with the movable contact so as to close, or open, a circuit between the contacts when the button is pressed. A movable contact may instead be provided on the free end of post 108 to bridge two electrical contacts on the PC board.

Figure 11:
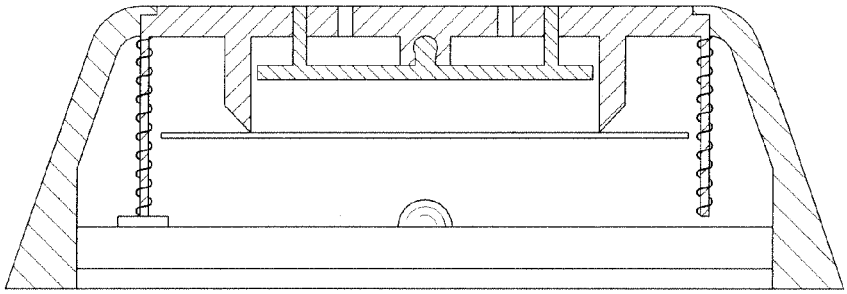
FIG. 11 is a cross-section of an embodiment of a cap assembly including an integral pushbutton switch in combination with a pair of LEDs and internal shutter configured as in FIGS. 7 and 8, respectively.

PC board 112 may also have one or more LEDs mounted thereon, configured as in FIG. 7, for example, with the board made wide enough to allow angular spacing of the micro switch and LED(s) around its periphery, e.g., 90° spacing between the micro switch and each of two diametrically opposed LEDs, which may be surface mount LEDs. An example of such a cap assembly, with a circular PC board, is depicted in FIG. 11, in which one of two opposed peripherally mounted LEDs is visible. In addition, or instead, the cap assembly may include an internal shutter as described above, as also shown in FIG. 11. Depending upon the configuration of the control circuit on board 30, operation of the switch controls sound, LED operation, or both.

In one preferred embodiment, the circuit is operative to mute the transducer but continue to energize the LED(s) in response to actuation of the pushbutton switch, so that a light pattern remains as a reminder to the operator that the condition that caused the alarm to be triggered is still present. The circuit may completely mute the transducer or substantially lower the volume. The circuit may also provide a switch output or an output signal indicative of pushbutton actuation to the external controller to which the warning device is connected. Alternatively, the circuit may be configured to respond to actuation of the pushbutton switch by turning the LED(s) off, or substantially dimming the light, but continuing to energize the transducer, at the original volume or a substantially lower volume, e.g., to generate a chirp sound.

In an alternative embodiment, the circuit provides a switch input for an external switch mounted elsewhere on the panel or at another external location. The circuit may be configured to mute the transducer but continue to energize the LED(s) in response to actuation of the switch, or may be configured to otherwise change the operating state of the sound generating element or the light source as described above.

Figure 12:
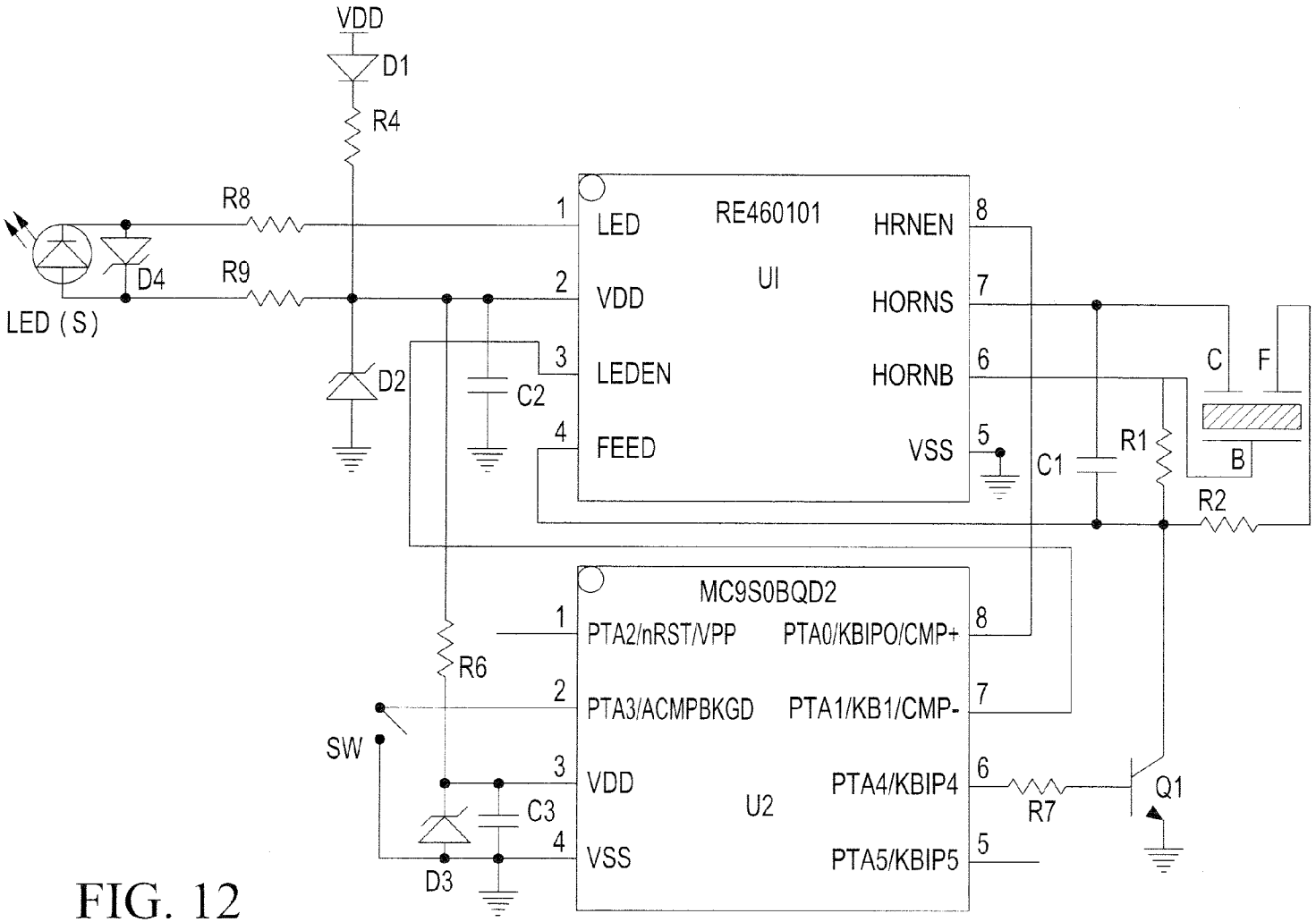
FIG. 12 is an electrical schematic of an embodiment of a control circuit for a multi-sensory warning device according to the present invention.
Figure 13:
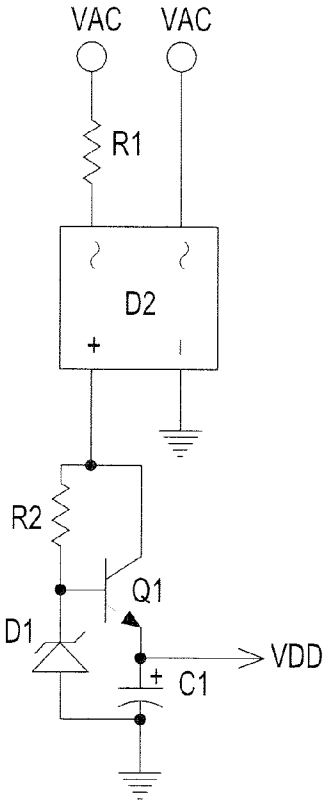
FIG. 13 is an electrical schematic of an AC rectifier which may be used to adapt the warning device for an AC power input.

FIG. 12 is an electrical schematic of one suitable control circuit for the embodiments of FIGS. 1-7 and other embodiments of a multi-sensory warning device according to the present invention, including, in particular, embodiments which combine a piezoelectric transducer, LED(s) and internal switch as described above. As shown, the circuit is adapted for DC power input. The AC version of the circuit is the same except that diodes D1 and D2 and resistor R4 are omitted, and a DC voltage is supplied to the VDD input of integrated circuit U1 from an AC rectifier such as the one shown in FIG. 13.

U1 is a horn/LED driver which, connected as shown, causes the piezoelectric transducer to oscillate in a feedback or self-oscillation mode when, with the circuit supplied with power from the external controller, the horn enable (HRNEN) input (pin 8) of U1 is held high by a microcontroller U2, which is programmed to hold its pin 8 continually high in this mode, and pin 6 of the microcontroller is held low such that transistor Q1 is turned off to allow feedback from the transducer to the feedback (FEED) input (pin 4) of U1. The circuit may alternatively be operated in a direct drive mode, in which feedback is eliminated by turning transistor Q1 on and thereby grounding pin 4 of U1, which also causes pin 7 of U1 to be held low. With pin 7 low, pin 6 is toggled high and low by the microcontroller via the connection from its pin 8 to pin 8 of U1, causing the piezoelectric transducer to oscillate at a frequency and amplitude determined by the pulse rate and duty cycle of the digital output signal on pin 8 of the microcontroller.

The microcontroller also controls the LED(s) through driver circuit U1, via pin 7 connected to the LED enable (LEDEN) input (pin 3) of U1 for simultaneous control of the LED(s). The microcontroller may be programmed to provide separate or coordinated control of the LED(s) and transducer. In particular, the microcontroller preferably mutes the transducer upon closure of the switch SW (e.g., switch 102 in FIG. 10), without affecting the LED(s). U1 is a driver circuit in the RE46CXXX series from Microchip Technology Inc., preferably a model RE46C100 or RE46C101 driver. U2 is preferably a microcontroller in the MC9S08 family commercially available from Freescale Semiconductor, Inc., e.g., a model MC9S08QD2 or MC9S08QD4 microcontroller.

The microcontroller may be programmed to respond to switch actuation in various ways such as the following:

- Turn the tone off until the device is electrically deactivated and is then reactivated by another alarm condition.
- Turn the tone off for a period of time and then turn the tone back on.
- Make the tone quieter until the device is electrically deactivated and reactivated.
- Make the tone quieter for a period of time, and then resume normal volume.
- Change to a different tone.

The visual signals may also be modified. For example, the original visual indication may remain activated, or may be changed to a different visual indication pattern. LEDs of one or more colors may be used to produce:

- a circular or spinning visual indication pattern caused by activating, in sequence, LEDs which are situated in a circular configuration inside the cap assembly.
- an alternating visual indication pattern caused by activating, one at a time, LEDs inside the cap assembly.
- a pulsating visual indication pattern caused by activating one or more LEDs at any chosen pulse rate or duty cycle including pulse rates that may vary with time.
- a visual indication pattern that gets brighter over time by increasing the brightness of the LEDs over a set time period.

The variations of audible and visual indications may be combined, for example:

- a circular or spinning visual indication pattern caused by activating, in sequence, LEDs which are situated in a circle type configuration inside the cap that is accompanied by a sound that logically corresponds such as a siren sound or is logically independent of the spinning visual indication pattern.
- an alternating visual indication pattern caused by activating LEDs inside the cap one at a time which are oriented across from each other that is accompanied by a sound that logically corresponds such as a warble sound or is logically independent of the alternating visual indication pattern.
- a pulsating visual indication pattern caused by activating one or more LEDs at any chosen pulse rate and duty cycle including pulse rates that may vary with time such as one that would speed up that is accompanied by a sound that logically corresponds such as an audible sound that beeps at the same visual pulse rate or is logically independent of the pulsating visual indication pattern.
- a visual indication pattern that gets brighter over time by increasing the brightness of the internal LEDs over a set time period that is accompanied by a sound that logically corresponds such as a sound that gets louder over time or is logically independent of the brightening visual indication pattern.
- a visual indication pattern that does two or more of the above visual patterns in sequence that are accompanied by a sound that may or may not logically correspond to the visual indication pattern.

All of the above sound and light variations, other than those with sequential LED activation, may be provided by suitable programming of the microcontroller of FIG. 12 and by connecting pin 7 or another suitable pin of the microcontroller to the LED enable (LEDEN) pin of U1 for simultaneous control of the LED(s). The microcontroller may also be programmed to switch from one of the above modes to another in response to a mode control command or multiple mode control signals supplied from the external controller, or an external switch, through connector 50 to a pin or pins of the microcontroller, e.g., pins 5 and 7 (with another pin used for LED control), or in response to a mode control command derived from operation of the internal switch. For sequential activation of multiple LEDs, the circuit may be modified by driving the LEDs from separate pins of the microcontroller, and adding more pins to the PC board in the cap, and associated drive transistors on the main PC board, as necessary for that purpose. Alternatively, sequential activation may be provided using a chaser circuit or a demultiplexer circuit in the cap. Another microcontroller that may be used to generate different audible signals in response to multiple electrical inputs from the user is disclosed in U.S. Pat. No. 6,310,540, which is incorporated herein by reference. Further disclosure of microprocessor circuitry allowing the generation of different sounds for different situations may be found in U.S. Patent Application Publication No. 2010/0102940, incorporated herein by reference.

In a simplified variation of the circuit of FIG. 12, the microcontroller is not used and pins 3 and 8 of U1 are tied high. In this embodiment, the LED(s) and transducer operate continuously whenever the circuit is supplied with power from the external controller.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected. For example, speakers and other sound generating elements are also contemplated, including, for example, a 20 mm mylar speaker, and a speaker assembly such as in U.S. Pat. No. 7,880,593, which is incorporated herein by reference.

We claim:

1. A panel-mountable audible and visual warning device, comprising:

a main housing configured to fit into a hole in the face of a mounting panel;

a cap on said main housing, said cap having a front wall and at least one side wall external to the panel when said device is operably mounted therein;

a piezoelectric transducer mounted within said cap, said cap and transducer together defining an audio-frequency resonant cavity having an orifice open to the environment; and at least one LED mounted within said cap in a position in front of the panel face in use and behind and radially outward of said transducer so as to emit light directly forward past said transducer.

2. The warning device of claim 1, wherein a plurality of LEDs are positioned in front of the panel face and behind and radially outward of said transducer so as to emit light directly forward past said transducer.

3. The warning device of claim 2, wherein said cap is a modular subassembly secured to the front end of said main housing, said subassembly containing said piezoelectric transducer and said LEDs external to the panel, said transducer mounted on a nodal mounting ring a predetermined distance from said front wall, said LEDs peripherally mounted on a printed circuit board supported by said at least one side wall.

4. The warning device of claim 3, wherein said LEDs are peripherally mounted such that they collectively have a substantially 180° forward-facing field of view external to the panel.

5. The warning device of claim 3, further comprising:

an electronic control circuit contained in said main housing, said control circuit having a first electrical connector; and a mating second electrical connector mounted on said printed circuit board in said cap and electrically connected to said piezoelectric transducer and said LEDs;

whereby said cap may be pre-assembled as a subassembly containing said piezoelectric transducer and said LEDs and then electrically connected to said control circuit.

6. The warning device of claim 1, wherein said main housing includes a cylindrical threaded portion, and wherein said piezoelectric transducer comprises a disc substantially as large in diameter as said threaded portion of said main housing.

7. The warning device of claim 6, wherein said cap is frusto-conical with its rear portion more than 25% larger in outer diameter than its front portion and said threaded portion of said main housing.

8. The warning device of claim 7, wherein the axial length of said cap external to the panel is more than 25% of the outer diameter of the rear portion of said cap.

9. A panel-mountable audible and visual warning device, comprising:

a main housing configured to fit into a hole in the face of a mounting panel;

a cap on said main housing, said cap having a front wall and at least one side wall external to the panel when said device is operably mounted therein;

a speaker mounted within said cap, said cap and speaker together defining an audio-frequency resonant cavity having an orifice open to the environment; and at least one LED mounted within said cap in a position in front of the panel face in use and behind and radially outward of said speaker so as to emit light directly forward past said speaker.

10. The warning device of claim 9, wherein a plurality of LEDs are positioned in front of the panel face and behind and radially outward of said speaker so as to emit light directly forward past said speaker.

11. The warning device of claim 10, wherein said cap is a modular subassembly secured to the front end of said main housing, said subassembly containing said speaker and said LEDs external to the panel, said LEDs peripherally mounted on a printed circuit board supported by said at least one side wall.

12. The warning device of claim 11, wherein said LEDs are peripherally mounted such that they collectively have a substantially 180° forward-facing field of view external to the panel.

13. The warning device of claim 11, further comprising:

an electronic control circuit contained in said main housing, said control circuit having a first electrical connector; and a mating second electrical connector mounted on said printed circuit board in said cap and electrically connected to said piezoelectric transducer and said LEDs;

whereby said cap may be pre-assembled as a subassembly containing said piezoelectric transducer and said LEDs and then electrically connected to said control circuit.

14. The warning device of claim 9, wherein said main housing includes a cylindrical threaded portion, and wherein said speaker is substantially as large in diameter as said threaded portion of said main housing.

15. The warning device of claim 14, wherein said cap is frusto-conical with its rear portion more than 25% larger in outer diameter than its front portion and said threaded portion of said main housing.

16. The warning device of claim 15, wherein the axial length of said cap external to the panel is more than 25% of the outer diameter of the rear portion of said cap.

* * * * *